United States Patent [19]

Mazzei

[11] 4,123,800

[45] Oct. 31, 1978

[54] MIXER-INJECTOR

[76] Inventor: Angelo L. Mazzei, 11001 Mountain View, Bakersfield, Calif. 93307

[21] Appl. No.: 798,242

[22] Filed: May 18, 1977

[51] Int. Cl.[2] ..... B01F 5/04

[52] U.S. Cl. ..... 366/150; 366/165

[58] Field of Search ..... 259/4 R, 18, 36; 137/604; 417/194; 366/150, 165, 339

[56] References Cited

U.S. PATENT DOCUMENTS

| | | | |
|---|---|---|---|
| 1,233,557 | 7/1917 | Curtis | 137/604 |
| 1,826,163 | 10/1931 | Barber | 137/604 |
| 2,563,002 | 8/1951 | Bissell | 259/4 R |
| 3,409,274 | 11/1968 | Lawton | 259/4 R |
| 3,788,557 | 1/1974 | Hamburg | 137/604 |
| 3,799,195 | 3/1974 | Hermans | 137/604 |

*Primary Examiner*—Robert W. Jenkins

*Attorney, Agent, or Firm*—Donald D. Mon

[57] ABSTRACT

A mixer-injector having a carrier stream inlet, an additive stream inlet and an outlet. Between the carrier stream inlet and the outlet there is a throat means having an axis of flow, a constricting portion of decreasing diameter, an expanding portion of increasing diameter, and a throat portion interconnecting them. Port means discharges from the additive stream inlet into the throat portion adjacent to the constricting portion. In the preferred embodiment, skew-oriented channel means is carried by the wall of the expanding portion.

14 Claims, 5 Drawing Figures

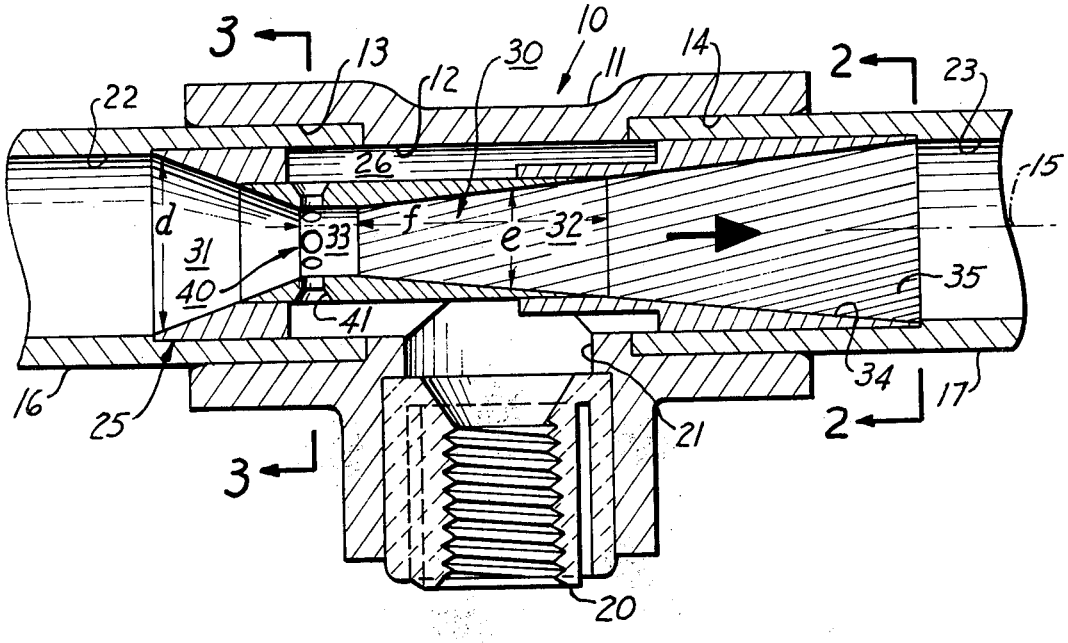

MIXER-INJECTOR

This invention relates to mixer-injectors.

There is an increasingly important requirement for injectors which can inject and mix one substance such as a liquid fertilizer into a carrier stream of a liquid such as water. The pressures available vary between about 20 psi to about 70 psi. It is desirable to require as little differential pressure as possible for the injection and mixing. A mixer-injector according to this invention can create a substantial suction with only about a 10 psi differential pressure. This is low, compared with other known injectors. It therefore utilizes a minimal amount of energy.

This device is useful, among other purposes, to mix liquid fertilizers, or concentrated sulfuric acid, into irrigation water with maximum efficiency and minimum pressure drop.

A mixer-injector according to this invention has a body with a carrier stream inlet, an additive stream inlet and an outlet. Between said carrier stream inlet and said outlet there is a throat means having a constricting portion of decreasing diameter, an expanding portion of increasing diameter, and a throat portion of substantial axial length interconnecting said constricting and expanding portions. Port means discharges from said additive stream inlet into said throat portion.

According to a preferred but optional feature of the invention, said port means is shaped as nozzles directed toward the axis of flow.

According to still another preferred but optional feature of the invention, skew-oriented channel means are formed on the wall of the expanding portion.

Figure 1:
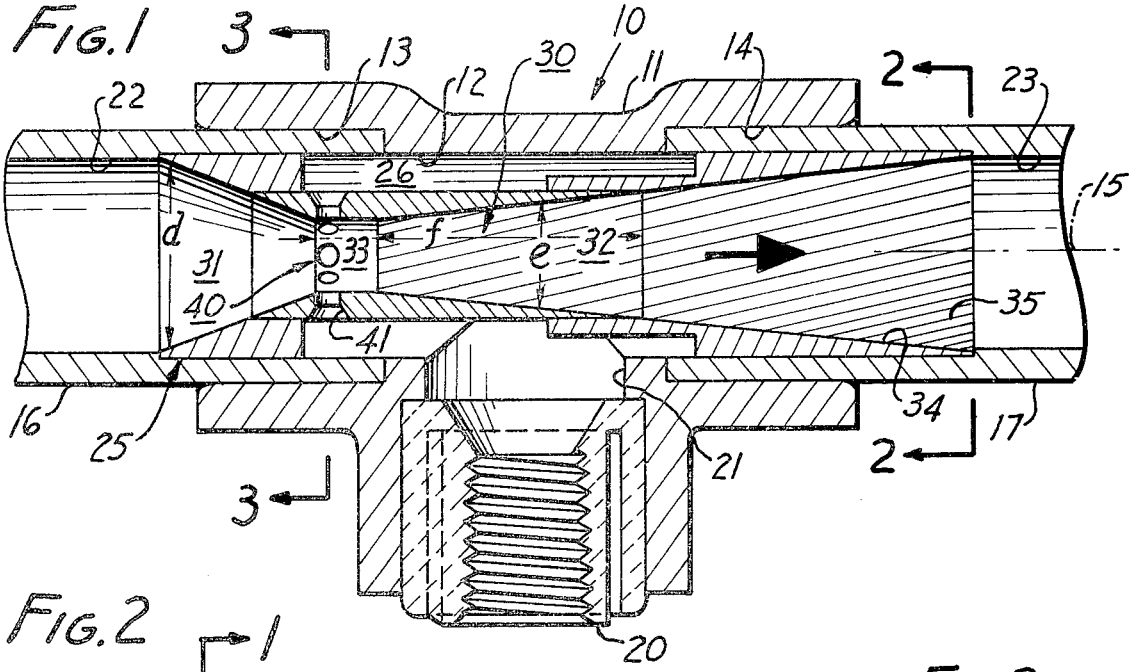
Figure 2:
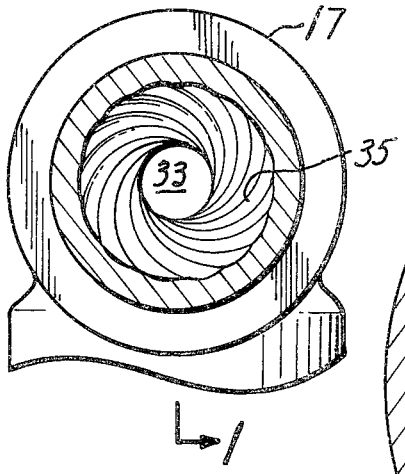
Figure 3:
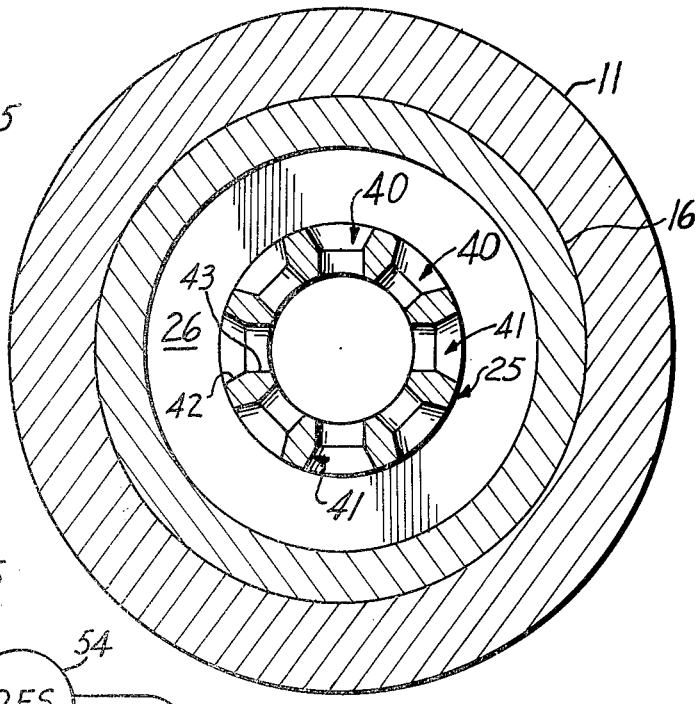
Figure 4:
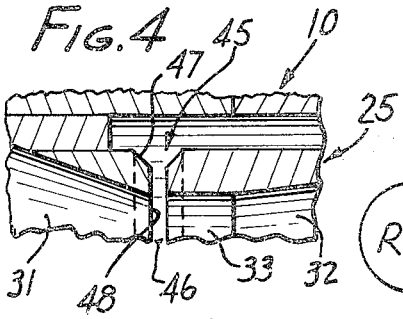
Figure 5:
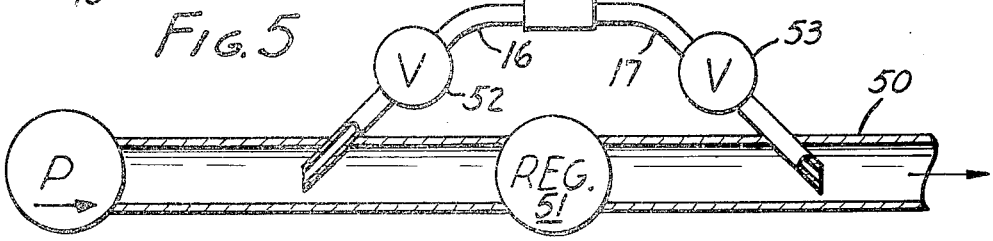

This invention will be fully understood from the following detailed description and the accompanying drawings in which:

FIG. 1 is an axial cross-section of the presently preferred embodiment of the invention taken at line 1—1 of FIG. 2;

FIGS. 2 and 3 are cross-sections taken at line 2—2 and 3—3 respectively in FIG. 1;

FIG. 4 is a fragmentary axial cross-section of another embodiment of the invention; and FIG. 5 shows the invention plumbed into an operating system.

The presently preferred embodiment of mixer-injector 10 according to the invention is shown in FIG. 1. It is intended to mix an additive with a carrier stream, for example concentrated sulfuric acid in a carrier stream of irrigation water.

The mixer-injector 10 includes a body 11 having a central bore 12 and a first and a second counterbore 13, 14 all extending concentrically along central axis of flow 15. A carrier stream pipe 16 fits in the first counterbore. An effluent pipe 17 fits in the second counterbore. The body also includes an additive fitting 20 to connect a pipe from a source of additive to an additive stream inlet 21.

Pipe 16 comprises a carrier stream inlet 22. Pipe 17 comprises an outlet 23. An insert 25 is placed in the body between the carrier stream inlet 22 and the outlet 23. This insert has a peripheral annular chamber 26 which receives material from the additive stream inlet. The insert carries throat means 30. Throat means 30 includes a constricting portion 31 of decreasing diameter "*d*", and an expanding portion 32 of increasing diameter "*e*", the change in the diameters referring to downstream displacement along the axis of flow. The throat means also includes a throat portion 33 which is preferably cylindrical and extends for a substantial axial length "*f*".

The inside wall 34 of the expanding portion is provided with skew-oriented channel means 35. These may be of "U" or "V" or square shaped ribs or channels formed in the wall. By "skew" is meant a twisting orientation whereby the individual means progresses around the axis of flow as it extends away from the throat portion.

Port means 40 comprises ports 41 which are angularly spaced-apart around the throat section and interconnect the annular chamber 26 to the inside wall of the throat portion. They are nozzle-shaped by a tapered (in this embodiment conical), portion 42 and a straight portion 43, and discharge toward the axis of flow. They are placed closely adjacent to the intersection of the throat portion and constricting portion, preferably contiguous to that intersection. They are closer to the intersection of the throat portion and the constricting portion than to the intersection of the throat portion and the expanding portion.

FIG. 4 shows a variation of the port means useful in the device of FIG. 1 instead of the individual ports 41. The port means 45 shown in FIG. 4 comprises a continuous peripheral slit 46 with a tapered section 47 and a straight portion 48. The basic action of port means 45 is the same as that of port means 40, except that the stream enters as a continuous peripheral stream instead of as a plurality of jets. This construction has the advantage that the axial length of the openings into the throat portion can be reduced, and injection occurs at a more optimal location.

FIG. 5 shows mixer-injector 10 plumbed into a system. It is shown as a partial by-pass in an irrigation pipe 50 having a regulator or reducer valve 51 to establish a differential pressure. Pipes 16 and 17 are plumbed into pipe 50 respectively upstream and downstream from valve 51. Shut off valves 52, 53 can isolate mixer-injector 10 for servicing. A reservoir or tank 54 provides a supply of additive material.

The structure illustrated as a by-pass can, of course, be a mainstream, instead.

The operation and features of this invention are as follows. The carrier stream pipe is connected to a source of carrier stream material such as irrigation water and the additive fitting is connected to a source of additive. Then with the carrier stream flowing, the cross-section of the stream will be reduced by the constricting section. In accordance with Bernoulli's principle, there will be a decrease in pressure and an increase in axial velocity. The position of the port means takes advantage of the momentum of the fluid's changing in direction, which causes a negative pressure where they are located. This effect is more pronounced contiguous to the intersection of the throat and constricting portions, and decreases downstream therefrom. For this reason, the port means is as close to that intersection as possible, although this invention comprehends port means located downstream therefrom, also, provided they are closer to that intersection than to the intersection of the throat and expanding portions. Because the constriction is conical, the forces tend to cancel each other as the flow of fluid changes its direction and causes a negative pressure in proportion to the distance from the point where it changes its direction and fluid velocity.

The arrangement as shown is different from that in a conventional venturi, and is more efficient than a venturi. The velocity and differential pressure required to cause a given negative pressure are considerably less than in a conventional venturi.

The negative pressure will cause aspiration of additive material, which discharges in a strong stream into the throat portion where it tends to make the flow somewhat turbulent. In addition to this turbulence, as the stream again expands and slows down its outer portions flow in the skew-oriented channel means and are given a twisting motion which augments the mixing operation. These skew-oriented means are optional. The injected mixed material then flows out the outlet to a point of use.

The specific dimensions of the device are not critical. They can be varied for different materials and for different pressure ranges. The device shown is drawn to scale in FIG. 1. The inside diameter of throat section 33 is 0.50 inches, and the diameter of the smallest portion of the ports 41 is approximately one-eighth inch. The remainder of the device may be scaled from FIG. 1 with knowledge of these dimensions. This device when plumbed into a system as shown in FIG. 5 readily injects as much as 2 gallons per minute into a stream with a differential pressure of only about 10½ psi, with an upstream pressure of about 33 psi and a downstream pressure of about 22½ psi. A vacuum of about 25 inches of mercury is drawn.

This invention thereby provides an efficient injector and mixer device. It can be made from any desired material of construction such as organic plastic materials, polypropylene or polyvinyl chloride being suitable examples, depending upon the use to which the device will be put.

This invention is not to be limited by the embodiments shown in the drawings and described in the description which are given by way of example and not of limitation but only in accordance with the scope of the appended claims.

I claim:

1. A mixer-injector having a body with a carrier stream inlet, an additive stream inlet, an outlet, and between said carrier stream inlet and said outlet a throat means having an axis of flow, a constricting portion of decreasing diameter, an expanding portion of increasing diameter both as they progress downstream from the carrier stream inlet, and a substantially cylindrical throat portion of substantial axial length interconnecting said constricting and expanding portions, and port means discharging from said additive stream inlet into said throat portion closely adjacent to the intersection of said throat portion and said constricting portion, there being a substantial length of imperforate throat portion downstream from said port means.

2. A mixer-injector according to claim 1 in which said port means comprises a pluraliity of angularly spaced-apart port means.

3. A mixer-injector according to claim 2 in which each of said ports includes a tapered portion and a straight portion, and discharges toward the center of said throat portion.

4. A mixer-injector according to claim 3 in which skew-oriented channel means progresses angularly around the axis of flow as they extend away from the throat portion, whereby to tend to rotate a portion of the stream around said axis of flow.

5. A mixer-injector according to claim 2 in which skew-oriented channel means progresses angularly around the axis of flow as it extends away from the throat portion, whereby to tend to rotate a portion of the stream around said axis of flow.

6. A mixer-injector according to claim 1 in which said port means is a continuous peripheral slit in the wall of said throat portion.

7. A mixer-injector according to claim 6 in which said slit comprises a tapered and a straight portion which discharges toward the center of said throat portion.

8. A mixer-injector according to claim 1 in which the additive stream inlet includes an annular chamber surrounding at least a portion of said throat portion, said ports means extending from said annular chamber into said throat portion.

9. A mixer-injector according to claim 1 in which skew-oriented channel means progresses angularly around the axis of flow as it extends away from the throat portion, whereby to tend to rotate a portion of the stream around said axis of flow.

10. A mixer-injector according to claim 1 in which the port means enters the throat portion contiguous to the constricting portion.

11. A mixer-injector according to claim 10 in which the additive stream inlet includes an annular chamber surrounding at least a portion of said venturi throat, said port means extending from said annular chamber into said throat portion.

12. A mixer-injector according to claim 11 in which skew-oriented channel means progresses angularly around the axis of flow as it extends away from the throat portion, whereby to tend to rotate a portion of the stream around said axis of flow.

13. A mixer-injector according to claim 12 in which said port means comprises a plurality of angularly spaced-apart ports.

14. A mixer-injector according to claim 12 in which said port means is a continuous peripheral slit in the wall of said throat portion.

* * * * *